US009939219B1

(12) United States Patent
Ulbrich et al.

(10) Patent No.: US 9,939,219 B1
(45) Date of Patent: Apr. 10, 2018

(54) LOADER

(71) Applicants: Mason Ulbrich, Saugus, CA (US); Kevin Schroeder, Simi Valley, CA (US); Jeff Schroeder, Simi Valley, CA (US)

(72) Inventors: Mason Ulbrich, Saugus, CA (US); Kevin Schroeder, Simi Valley, CA (US); Jeff Schroeder, Simi Valley, CA (US)

(73) Assignee: Ulbrich Schroeder Design Corp, Simi Valley, CA (US)

( * ) Notice: Subject to any disclaimer, the term of this patent is extended or adjusted under 35 U.S.C. 154(b) by 0 days.

(21) Appl. No.: 15/406,411

(22) Filed: Jan. 13, 2017

(51) Int. Cl.
*F41A 9/83* (2006.01)
*F41C 7/00* (2006.01)
*F41A 9/01* (2006.01)

(52) U.S. Cl.
CPC ..... *F41A 9/83* (2013.01); *F41A 9/01* (2013.01); *F41C 7/00* (2013.01)

(58) Field of Classification Search
CPC ..... F41A 9/82; F41A 9/83; F41A 9/84; F41A 9/01; F41C 7/00
See application file for complete search history.

(56) References Cited

U.S. PATENT DOCUMENTS

| | | | | |
|---|---|---|---|---|
| D402,605 | S | 5/1889 | Mauser | |
| 2,783,570 | A | 4/1954 | Kunz | |
| 4,509,284 | A * | 4/1985 | Naber | F41A 9/83 42/87 |
| 4,614,052 | A | 9/1986 | Brown | |
| 4,756,110 | A | 7/1988 | Beltron | |
| 4,862,621 | A * | 9/1989 | Kearney | F41A 9/83 42/87 |
| 5,402,594 | A | 4/1995 | Switzer | |
| 6,754,987 | B1 | 6/2004 | Cheng | |
| 9,279,631 | B2 | 3/2016 | Barnhart | |
| 9,335,108 | B2 | 5/2016 | Cauley | |
| 2009/0044440 | A1 | 2/2009 | Tal | |
| 2014/0298704 | A1 | 10/2014 | Niccum | |
| 2015/0198395 | A1 | 7/2015 | Visinski | |

FOREIGN PATENT DOCUMENTS

| | | |
|---|---|---|
| CH | 669253 | * 12/1978 |
| GB | 1058333 | * 2/1976 |

* cited by examiner

*Primary Examiner* — Stephen Johnson
(74) *Attorney, Agent, or Firm* — Todd R. Miller

(57) ABSTRACT

A loading device and method of using same with a rifle having a fixed magazine are disclosed. The loading device may comprise a housing having a channel, a plunger slideably disposed within the channel, and a spout extending away from the housing. The spout is configured to fit within an ejection port of the rifle. The plunger may include an articulating arm extending away from one end of the plunger, wherein the arm includes a plug disposed about one end for pushing ammunition cartridges into the fixed magazine. The loading device advantageously permits efficient and rapid reloading of ammunition into the fixed magazine.

6 Claims, 6 Drawing Sheets

LOADER

BACKGROUND

The present disclosure relates generally to firearms and particularly to rifles and the reloading of ammunition in a rifle that has a fixed magazine.

SUMMARY

One exemplary embodiment of the disclosed subject matter is a loading device comprising a housing having a first end and an opposing second end. The housing has a first opening at the first end. The housing also has a second opening at the second end. The housing includes a channel running from the first opening to the second opening. A plunger is slideably disposed within the channel. A spout extends away from the first opening of the housing, wherein the spout is configured to fit within an ejection port of a rifle having a fixed magazine.

The plunger may include an articulating arm extending away from the plunger. The arm has a first and a second opposing end, wherein the arm includes a first plug disposed about the first end and a second plug disposed about the second end of the arm. The plunger may include a socket formed into an end of the plunger, wherein the first plug of the arm is configured to fit within the socket.

The loading device may also include a stop extending from one end of the plunger, a piston extending from the stop, a spring disposed about piston, and a cap enclosing the first opening of the housing. A handle may be in communication with the stop, wherein the housing includes a slot configured to allow the handle and stop to move along at least a portion of the length of the housing.

Another exemplary embodiment of the disclosed subject matter is a rifle comprising a butt, a muzzle, a receiver disposed between the butt and the muzzle, and a magazine fixed to the rifle between the butt and the muzzle, wherein the magazine is in communication with the receiver. An ejection port is also in communication with the receiver. The rifle also includes a loading device comprising a housing having a channel, a plunger slideably disposed within the channel, and a spout extending away from the housing. The spout is configured to fit within the ejection port. The plunger may include an articulating arm extending away from one end of the plunger. The arm may include a plug disposed about one end of the arm for pushing ammunition cartridges into the fixed magazine. The plunger may be biased toward the receiver. The housing may include a stop ledge configured to abut the rifle once the loading device is inserted into the ejection port. The spout may include a retaining tab for keeping ammunition cartridges within the loading device once inserted therein.

A further exemplary embodiment of the disclosed subject matter is a method of loading ammunition into a rifle having a fixed magazine and an ejection port. The method may comprise pushing an ammunition cartridge into a loader, wherein the loader comprises a housing having a channel, a plunger slideably disposed within the channel, and a spout extending away from the housing. The method may further comprise inserting the spout of the loader into the ejection port of the rifle, and moving the plunger toward the ejection port of the rifle until the ammunition cartridge enters the fixed magazine of the rifle.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

Many popular modern firearms are fed ammunition through the use of a detachable magazine. This magazine may be removed when empty and replaced with a full magazine. Some rifles are designed to preclude the ability to accept a detachable magazine, i.e., the rifle has a "fixed" magazine. A known method of reloading these types of fixed-magazine rifles involves the use of a stripper clip. As reloading via a stripper clip alone is often difficult, a stripper clipper guide is typically needed. Such a guide may be a separate tool or built into the rifle. Regardless of whether the stripper clip guide is separate from or integrated with the rifle, reloading via a stripper clip and a stripper clip guide is usually a cumbersome, slow task.

Accordingly, an ergonomic device that permits efficient and rapid reloading of ammunition into a rifle with a fixed magazine is desired.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

Figure 1:
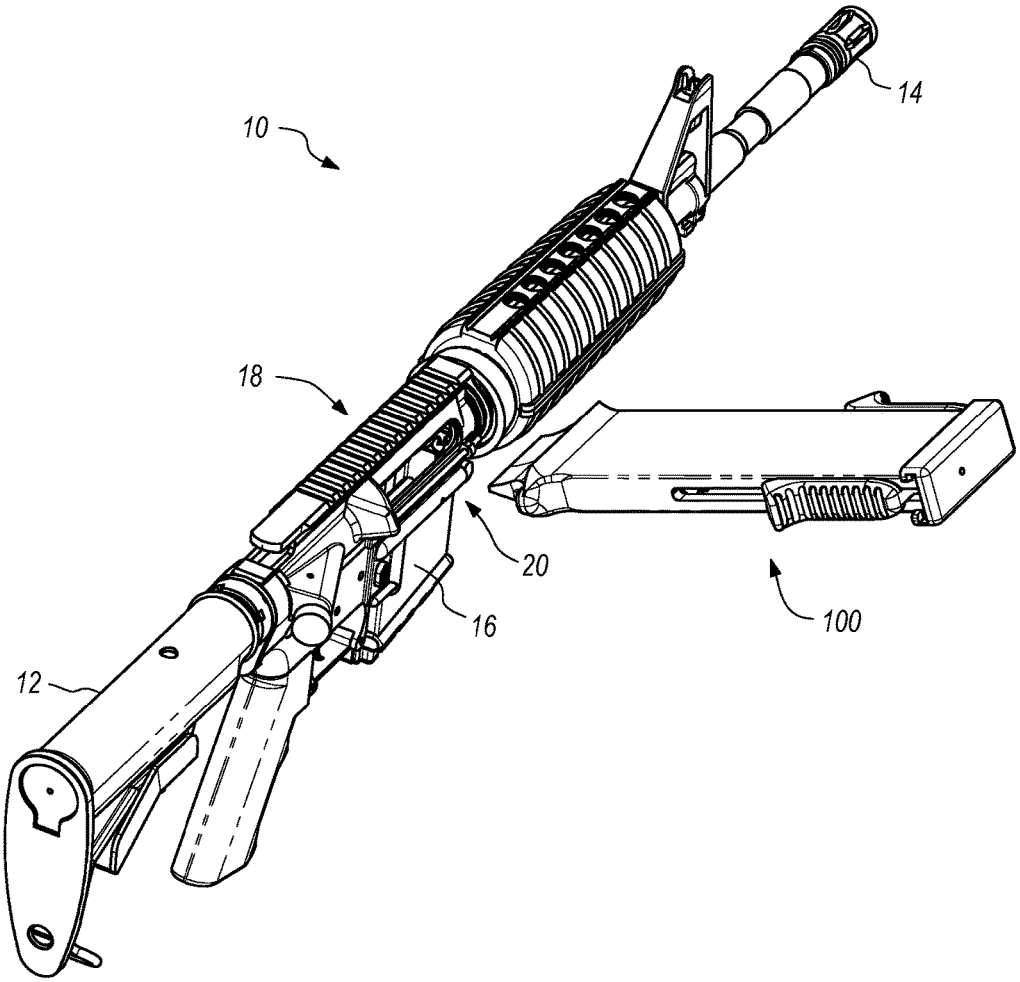
FIG. 1 is a perspective view of an embodiment of the loader disclosed herein for use with a rifle.

FIG. 1 illustrates a perspective view of an embodiment of the inventions disclosed herein for use with a rifle 10. The rifle 10 may comprise a butt 12 at one end and a muzzle 14 at an opposing end. Proximate the middle of the two ends lays a fixed magazine 16 that may store ammunition. Ammunition in the receiver 18 is fired and then ejected through ejection port 20.

The novel loading device 100 disclosed herein may be seen adjacent to the ejection port 20 of the rifle 10 illustrated in FIG. 1. Turning to FIGS. 2A through 6B, the loading device 100 may comprise a housing 102 having a first end 104 and an opposing second end 106. A first opening 108 is at the first end 104. A second opening 109 is at the second end 106. A channel 110 runs the length of the housing 102 from the first opening 108 to the second opening 109. The channel 110 is preferably shaped to accommodate the general profile dimensions of the applicable ammunition cartridges, such as cartridges 150 seen in FIG. 4, being used. In this regard, channel 110 may be rectangular or oval shaped to accommodate cartridges. The channel 110 may incorporate ribs to interface with the cartridge rim. In the alternative, the channel 110 may be smooth. The channel 110 is long enough to hold the desired amount of cartridges and with a geometry that allows the cartridges to slide through easily.

A spout 112 may extend away from the housing 102 at the second end 106. The spout 112 is preferably shaped or otherwise configured to be inserted through the ejection port 20. The geometry of the spout 112 should also align the end of the spout 112 with the top of the fixed magazine 16.

A plunger 114 is disposed within the channel 110. The plunger 114 may be biased via a spring or the like. Such a biasing mechanism 116 may comprise a stop 118 at one end of the plunger 114. A piston 120 or the like may extend away from the stop 118 toward the first end 104 of housing 102. A spring 122 may be disposed around the piston 120 inside the channel 110. To keep the spring 122 within the channel 110, a cap 124 may enclose the first opening 108 of the housing 102. The cap 124 also serves as a base from which the spring 122 may be loaded or biased against. A handle 126 may be in communication with the stop 118 to actuate the biasing mechanism 116. To permit the handle 126 to slide along the perimeter of the housing 102, a slot 128 is cut into the housing 102. The handle 126 may have ribs 127 that allow a user's hand to grip the handle 126 for easier actuation.

Figure 2A:
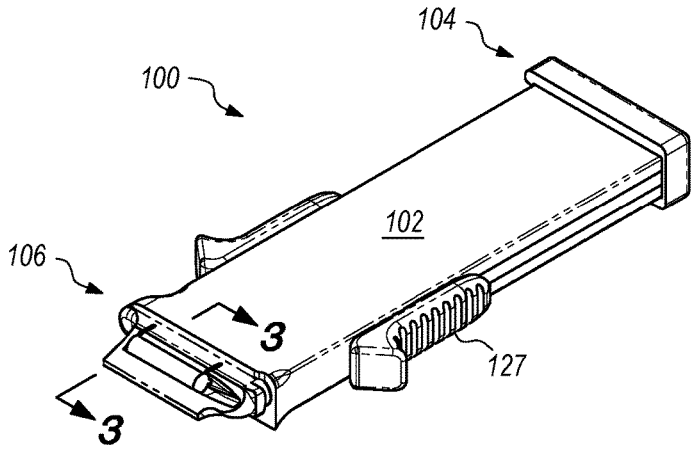
FIG. 2A is a perspective view of the loader shown in FIG. 1.
Figure 2B:
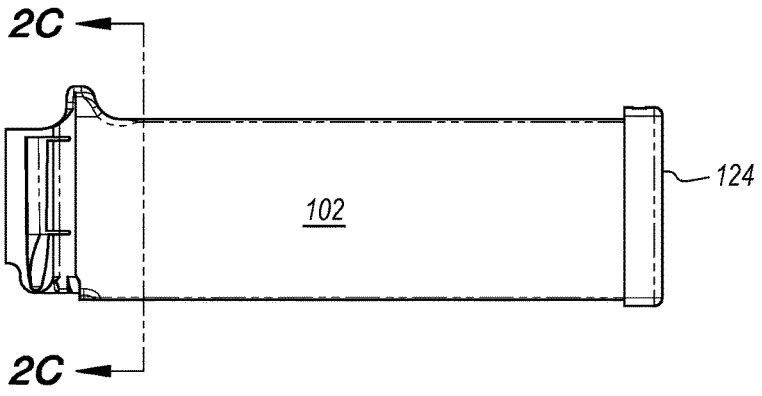
FIG. 2B is a bottom plan view of the loader.
Figure 2C:
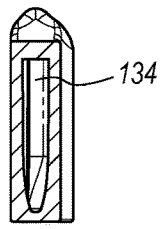
FIG. 2C is a cross section through the loader taken along section line 2C-2C in FIG. 2B.
Figure 3:
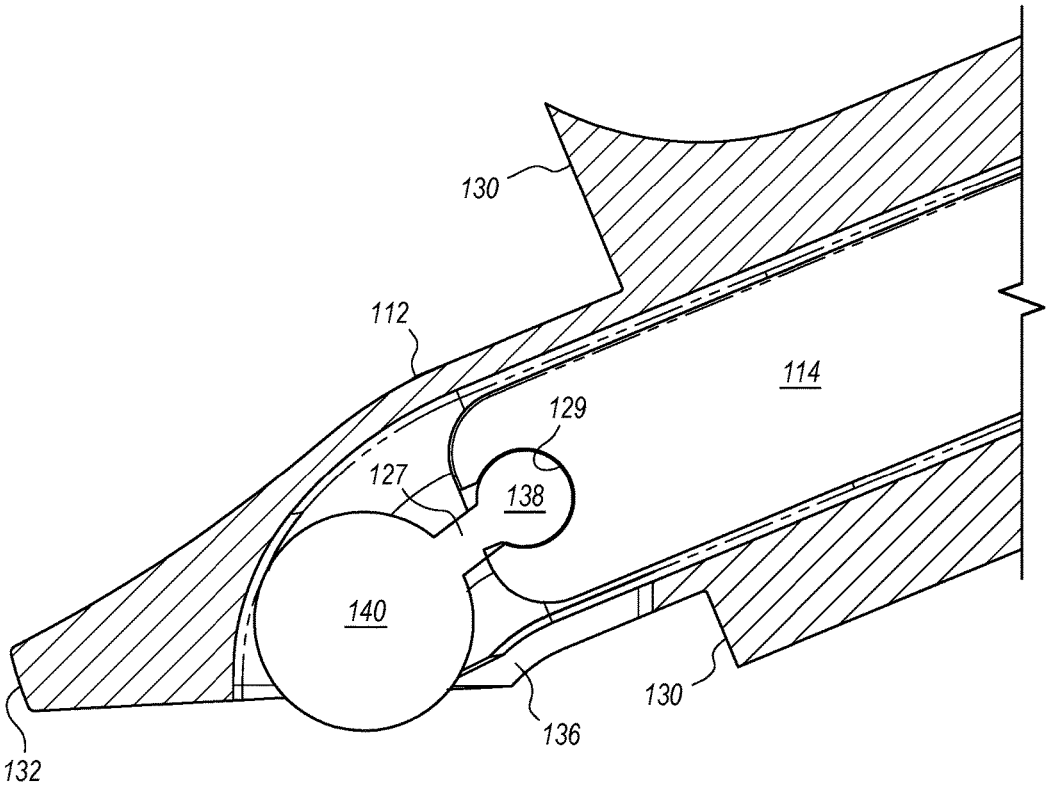
FIG. 3 is a detailed cross section of the loader taken along section line 3-3 in FIG. 2A.
Figure 4:
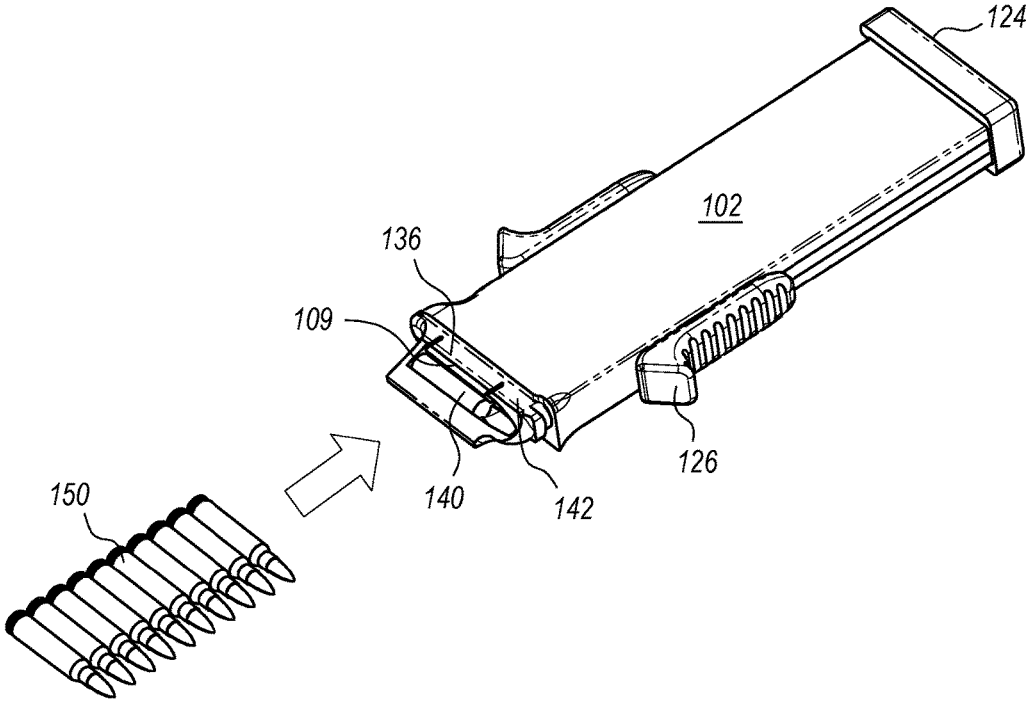
FIG. 4 is a perspective view of the loader with loose ammunition.

As best seen in FIG. 3, the housing 102 may also include one or more stop ledges 130 at the second end 106 of housing 102. The stop ledge 130 contacts the outside surface of the rifle 10, preventing over-insertion or misalignment. The spout 112 may have one or more tabs 142 or the like that interface with the inside of the ejection port 20 to prevent the loader 10 from moving during operation. The spout 112 may also have an external stop tab 132 that interfaces with the interior of the rifle 10, aligning the spout 112 with the magazine 16. As best seen in FIG. 2C, the spout 112 may include a cartridge receiver 134 in communication with the channel 110 for receiving ammunition cartridges 150. A retaining tab 136 may be disposed about the spout 112 to prevent the cartridges from falling out of the spout 112 once inserted into the channel 110.

The plunger 114 may include an arm 127 extending away from one end. The arm 127 is preferably flexible and articulating. The articulation means may include a first plug 138 disposed at one end of the arm 127 and a second plug 140 at the opposing other end. The first plug 138 is configured to fit within a socket 129 formed in the plunger 114. The second plug 140 is preferably larger than the first plug 138 to allow for significant surface area to engage an ammunition cartridge contained within channel 110. Instead of a plug 138 and socket 129 arrangement, the arm 127 may be integral with the plunger 114.

FIGS. 4 through 6B illustrate the novel loading device 100 in operation. Starting with FIG. 4, loose ammunition cartridges 150 are inserted into the empty loading device 100 through the cartridge receiver 134. Once in the receiver 134, each cartridge 150 is pushed past the retaining tab 136 until up against the plunger 114 and preferably the second plug 140 of the articulating arm 127 should the latter be used. If a biasing mechanism 116 is used, then as each cartridge 150 is inserted, the spring 122 is compressed against the cap 124. After the desired amount of cartridges 150 have been inserted into loading device 100, the user is now ready to insert the loading device 100 into a rifle such as rifle 10 with its fixed magazine 16.

Figure 5A:
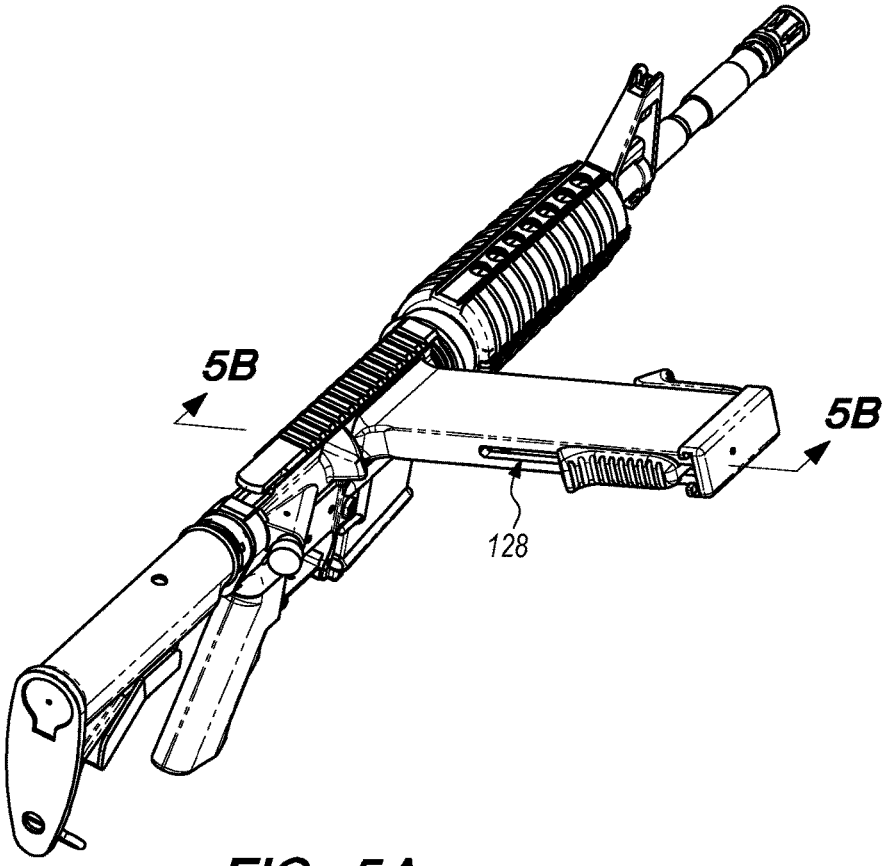
FIG. 5A is a perspective view of the loader inserted in the rifle seen in FIG. 1.
Figure 5B:
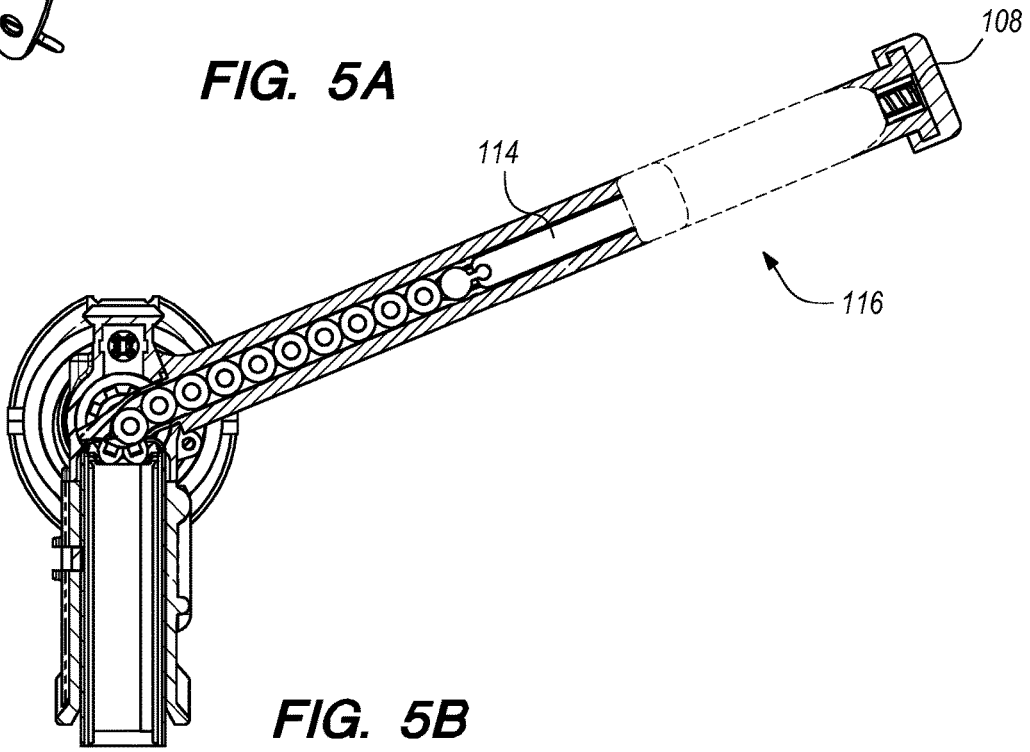
FIG. 5B is a cross section through the loader and rifle taken along section line 5B-5B in FIG. 5A.

FIGS. 5A and 5B show the loading device 100 has been inserted into the ejection port 20, perpendicular to the centerline of the rifle 10, until the loading device 100 stopped against the outer surface of the rifle 10. In this manner, the spout 112 will now be inside the rifle 10, with stop tab 132 contacting the far inner surface of the receiver 20.

Figure 6A:
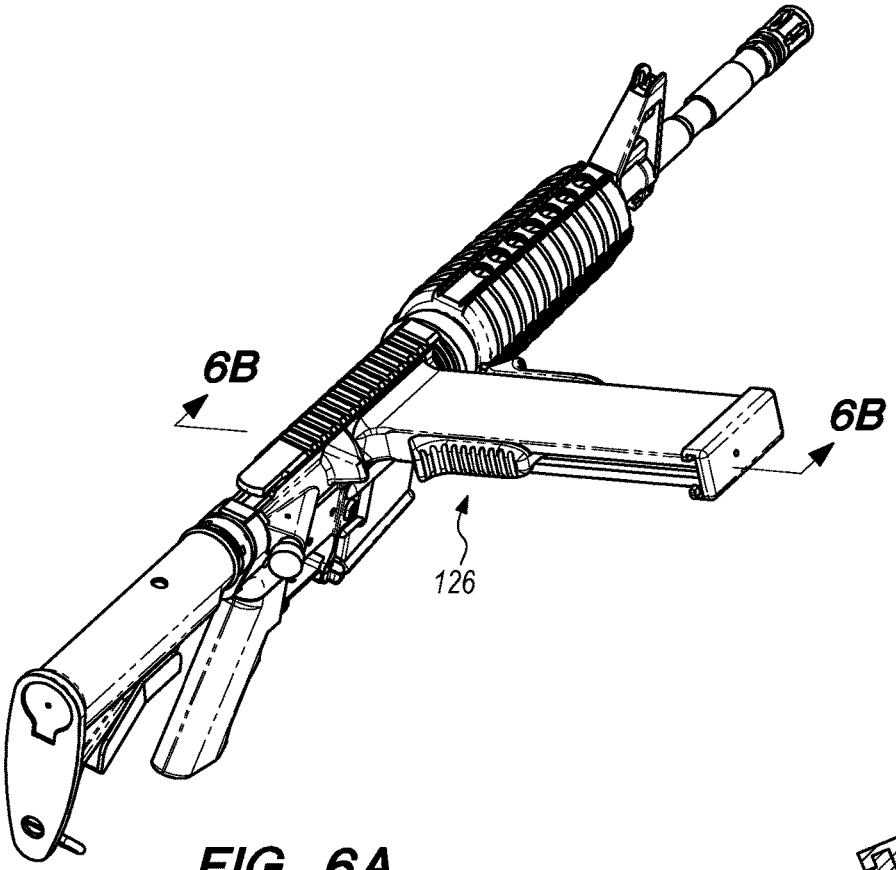
FIG. 6A is a perspective view of the loader inserted into the rifle with the plunger actuated.
Figure 6B:
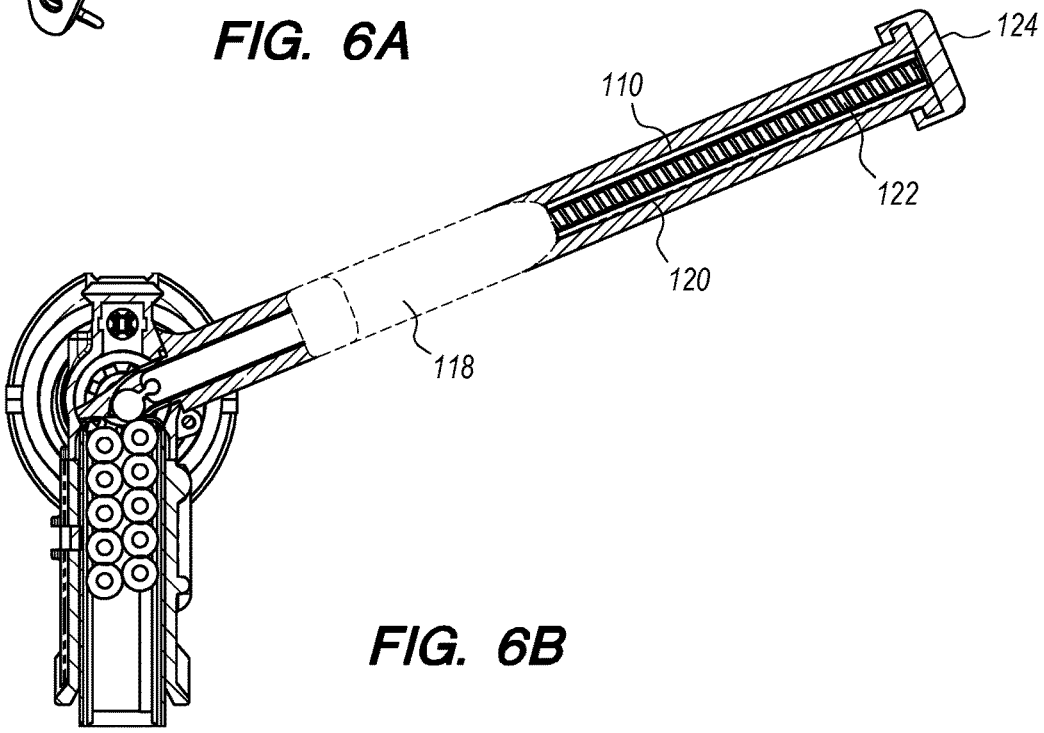
FIG. 6B is a cross section through the loader and rifle taken along section line 6B-6B in FIG. 6A.

Once the loading device 100 has been inserted into the ejection port 20 of the rifle 10, the user may now easily and quickly push the cartridges 150 into the fixed magazine 16 due to the ergonomic configuration of the housing 120 and the handle 126 with its ribs 127. In operation, the user simply grabs the handle 126 and slides it downward toward the spout 112. Doing so also forces the plunger 114 downward since it is in communication with the handle 126. Due to the flexible articulation of the arm 127 and the plug 140, each cartridge 150 is advantageously pushed all the way out of the end of the spout 112 and into the fixed magazine 16, as best seen in FIG. 6B.

While certain embodiments have been described, the embodiments have been presented by way of example only and are not intended to limit the scope of the inventions. Indeed, the novel loading device described herein may be embodied in a variety of other forms. Furthermore, various omissions, substitutions, and changes in the form of the disclosed elements may be made without departing from the spirit of the inventions. The accompanying claims and their equivalents are intended to cover such forms or modifications as would fall within the scope and spirit of the inventions.

The invention claimed is:

1. A loading device comprising:

a housing having a first end and an opposing second end, wherein the housing has a first opening at the first end, wherein the housing has a second opening at the second end, and wherein the housing includes a channel running from the first opening to the second opening;

a plunger slideably disposed within the channel, wherein the plunger includes an articulating arm extending away from the plunger, wherein the arm has a first and a second opposing end, and wherein the arm includes a first plug disposed about the first end and a second plug disposed about the second end of the arm; and a spout extending away from the first opening of the housing.

2. The loading device of claim 1, wherein the plunger includes a socket formed into an end of the plunger, wherein the first plug of the arm is configured to fit within the socket.

3. The loading device of claim 2, wherein the first plug has a diameter, wherein the second plug has a diameter, wherein the diameter of the first plug is smaller than the diameter of the second plug.

4. The loading device of claim 1, further comprising a stop extending from one end of the plunger, a piston extending from the stop, a spring disposed about the piston, and a cap enclosing the first opening of the housing.

5. The loading device of claim 4, wherein the housing has a length, and further comprising a handle in communication with the stop, and wherein the housing includes a slot configured to allow the handle and stop to move along at least a portion of the length of the housing.

6. The loading device of claim 1, wherein the spout includes an external stop tab protruding from one end of the spout.

* * * * *